US007749296B2

(12) United States Patent
Han et al.

(10) Patent No.: US 7,749,296 B2
(45) Date of Patent: Jul. 6, 2010

(54) CYCLONE DUST-SEPARATING APPARATUS OF VACUUM CLEANER

(75) Inventors: Jung-gyun Han, Gwangju (KR); Jang-keun Oh, Gwangju (KR); Seung-yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 611 days.

(21) Appl. No.: 11/786,867

(22) Filed: Apr. 13, 2007

(65) Prior Publication Data

US 2007/0271725 A1 Nov. 29, 2007

Related U.S. Application Data

(60) Provisional application No. 60/808,332, filed on May 25, 2006.

(30) Foreign Application Priority Data

Jun. 29, 2006 (KR) ..... 10-2006-0059181
Nov. 20, 2006 (KR) ..... 10-2006-0114381

(51) Int. Cl.
*B01D 47/00* (2006.01)

(52) U.S. Cl. ..... 55/429; 55/337; 55/447; 55/459.1; 55/DIG. 3; 15/353

(58) Field of Classification Search ..... 55/429, 55/337, 447, 459.1, DIG. 3; 15/353
See application file for complete search history.

(56) References Cited

U.S. PATENT DOCUMENTS 4,265,640 A * 5/1981 Bielefeldt ..... 95/271
5,066,315 A * 11/1991 Haberl et al. ..... 95/271
6,168,641 B1 * 1/2001 Tuvin et al. ..... 55/337

(Continued)

FOREIGN PATENT DOCUMENTS

EP 1707095 10/2006

(Continued)

OTHER PUBLICATIONS

Office Action dated May 28, 2007 from corresponding Korean Intellectual Property Office Patent Application No. 2006-59181.

(Continued)

*Primary Examiner*—Jason M Greene
*Assistant Examiner*—Dung Bui
(74) *Attorney, Agent, or Firm*—Ohlandt, Greeley, Ruggiero & Perle, L.L.P.

(57) ABSTRACT

A cyclone dust-separating apparatus is disclosed. The dust-separating apparatus includes a cyclone unit having an air inlet and an air outlet so as to remove dust or dirt from air, and a dust bin joined to a bottom end of the cyclone unit so as to store the dust or dirt separated by the cyclone unit. The cyclone unit is installed in such a manner that a longitudinal axis thereof is substantially horizontally arranged. The dust bin is installed in such a manner that a longitudinal axis thereof is substantially perpendicular to the longitudinal axis of the cyclone unit. The dust bin has an air outflow passage connected with the air outlet, so that air discharged from the cyclone unit passes through the dust bin and then discharges in a bottom end direction of the dust bin.

14 Claims, 7 Drawing Sheets

U.S. PATENT DOCUMENTS

| | | | | |
|---|---|---|---|---|
| 6,350,292 | B1 | 2/2002 | Lee et al. | 55/459.1 |
| 6,502,277 | B1 * | 1/2003 | Petersson et al. | 15/352 |
| 6,524,358 | B2 * | 2/2003 | Yang | 55/337 |
| 6,572,668 | B1 * | 6/2003 | An et al. | 55/428 |
| 6,746,500 | B1 | 6/2004 | Park et al. | 55/343 |
| 7,326,268 | B2 * | 2/2008 | Oh et al. | 55/343 |
| 7,390,339 | B1 * | 6/2008 | Warrick et al. | 55/346 |
| 7,398,578 | B2 * | 7/2008 | Lee | 15/327.2 |
| 2004/0139710 | A1 * | 7/2004 | Illingworth et al. | 55/406 |
| 2004/0231091 | A1 * | 11/2004 | Oh | 15/347 |
| 2005/0072130 | A1 * | 4/2005 | Yang et al. | 55/429 |
| 2005/0223520 | A1 * | 10/2005 | Greene et al. | 15/353 |
| 2005/0252179 | A1 * | 11/2005 | Oh et al. | 55/337 |
| 2006/0162118 | A1 * | 7/2006 | Murphy et al. | 15/352 |
| 2006/0168923 | A1 * | 8/2006 | Lee et al. | 55/345 |
| 2006/0272300 | A1 * | 12/2006 | Kim et al. | 55/429 |
| 2007/0011998 | A1 * | 1/2007 | Yoo et al. | 55/337 |

FOREIGN PATENT DOCUMENTS

| | | |
|---|---|---|
| GB | 2353962 | 3/2001 |
| JP | 2004-033661 | 2/2004 |
| KR | 1020000067145 | 11/2000 |
| WO | WO 00/74548 | 12/2000 |

OTHER PUBLICATIONS

Search and Examination Report dated Sep. 5, 2007 corresponding to United Kingdom Patent Application No. 0709050.9.

* cited by examiner

CYCLONE DUST-SEPARATING APPARATUS OF VACUUM CLEANER

CROSS-REFERENCE TO RELATED APPLICATIONS

This application claims the benefit under 35 U.S.C. §119 (e) of U.S. Provisional Patent Application No. 60/808,332, filed May 25, 2006, in the United States Patent and Trademark Office, and claims the benefit under 35 U.S.C. §119(a) Korean Patent Application Nos. 10-2006-0059181 and 10-2006-0114381, filed on Jun. 29, 2006 and Nov. 20, 2006, respectively, in the Korean Intellectual Property Office, the entire contents of each of which are hereby incorporated by reference.

BACKGROUND OF THE INVENTION

1. Field of the Invention

The present disclosure relates to a vacuum cleaner. More particularly, the present disclosure relates to a cyclone dust-separating apparatus of a vacuum cleaner, which draws in an external air and then separates dust or dirt therefrom.

2. Description of the Related Art

In general, a cyclone dust-separating apparatus provided in a vacuum cleaner is an apparatus, which whirls air laden with dirt or dust and separates the dirt or dust therefrom. Such a cyclone dust-separating apparatus has been recently widely used because it can be semi-permanently used without any inconvenience of frequently replacing dust bags.

As disclosed in U.S. Pat. No. 6,350,292, a cyclone dust-separating apparatus usually has a cyclone unit vertically and elongately installed, a cyclone body with an air inlet and an air outlet formed at a side and a top thereof, and a dust bin connected to a bottom part of the cyclone unit. Accordingly, external air is drawn in through the side of the cyclone body and lowered while being swirled therein, and dirt or dust removed from the air is collected in the dust bin. However, such a conventional cyclone dust-separating apparatus requires forming the dust bin in a relatively small size because the cyclone unit has large height. As a result, the conventional cyclone dust-separating apparatus is inconvenient to use, in that the dirt or dust collected in the dust bin should be frequently dumped.

In addition, Korean Patent Publication No. 412,583 discloses a cyclone dust-separating apparatus of an upright cleaner, in which a dust bin is coupled to a bottom end of a cyclone unit, the diameter of the former being equal to that of the latter. External air drawn into the cyclone unit through a side of the cyclone unit is lowered while whirling within an internal space of the dust bin as well as within an internal space of the cyclone unit. Accordingly, such a conventional cyclone dust-separating apparatus is disadvantageous in that because the cyclone unit is vertically arranged, the capacity of the dust bin is relatively small. Furthermore, there is a problem in that because the air whirling within the cyclone unit is lowered to the internal space of the dust bin, the dust stored within the dust bin is entrained by the swirling air and flows backward to the cyclone unit.

SUMMARY OF THE INVENTION

An aspect of the present disclosure is to address at least the above problems and/or disadvantages and to provide at least the advantages described below. Accordingly, an aspect of the present disclosure is to provide a cyclone dust-separating apparatus having a dust bin, the volume of which is increased as compared with other cyclone dust-separating apparatuses of the same height.

Another aspect of the present disclosure is to provide a cyclone dust-separating apparatus in which dirt or dust collected in the dust bin is prevented from flowing backward.

In accordance with an aspect of the present disclosure, a cyclone dust-separating apparatus includes a cyclone unit having an air inlet and an air outlet so as to separate dust or dirt from air, the cyclone unit being installed in such a manner that the longitudinal axis thereof is substantially horizontally arranged, and a dust bin joined to the bottom end of the cyclone unit so as to store the dust or dirt separated in the cyclone unit, the dust bin being installed in such a manner that the longitudinal axis thereof is substantially perpendicular to the longitudinal axis of the cyclone unit. The dust bin has an air outflow passage connected with the air outlet, so that air discharged from the cyclone unit passes through the dust bin and then discharges in a bottom end direction of the dust bin. Accordingly, the size of the dust bin can be increased as compared with other cyclone dust-separating apparatuses of the same height, thereby increasing a dust-separating capacity of the cyclone dust-separating apparatus. In addition, because the air whirls around the longitudinal axis of the cyclone unit, which is horizontally arranged, the dust or dirt stored in the dust bin, the longitudinal axis of which is substantially vertically arranged, cannot flow backward to the cyclone unit again. Also, because the air outflow passage discharging the air from a cyclone chamber of the cyclone unit is configured to pass through the dust bin, a piping loss of the discharged air can be reduced.

Here, the air outflow passage may be disposed to penetrate a dust bin chamber of the dust bin in an up-and-down direction. Particularly, the air outflow passage may be formed on a side of the dust bin chamber, so that a lower part thereof has a passage width gradually enlarged larger than that of an upper part thereof.

In addition, preferably, but not necessarily, the apparatus may further include a filter unit joined to a bottom end of the dust bin to filter dust laden in the air discharged from the cyclone unit. Accordingly, a dust-separating efficiency is improved.

Here, the filter unit may be configured to include a filter cover joined to the bottom end of the dust bin to form a filter chamber of predetermined volume, and a filter member installed in the filter chamber.

According to an exemplary embodiment of the present disclosure, the cyclone unit may include a cyclone body, and a guide unit detachably mounted on the cyclone body, and the cyclone body may include an inner body to form a cyclone chamber, and an outer body to surround the inner body. Here, the inner body may be formed in a laid cylinder shape, and the outer body may be formed in a stand-up cylinder shape.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, certain exemplary embodiments of the present disclosure will be described in detail with reference to the accompanying drawing figures.

Figure 1:
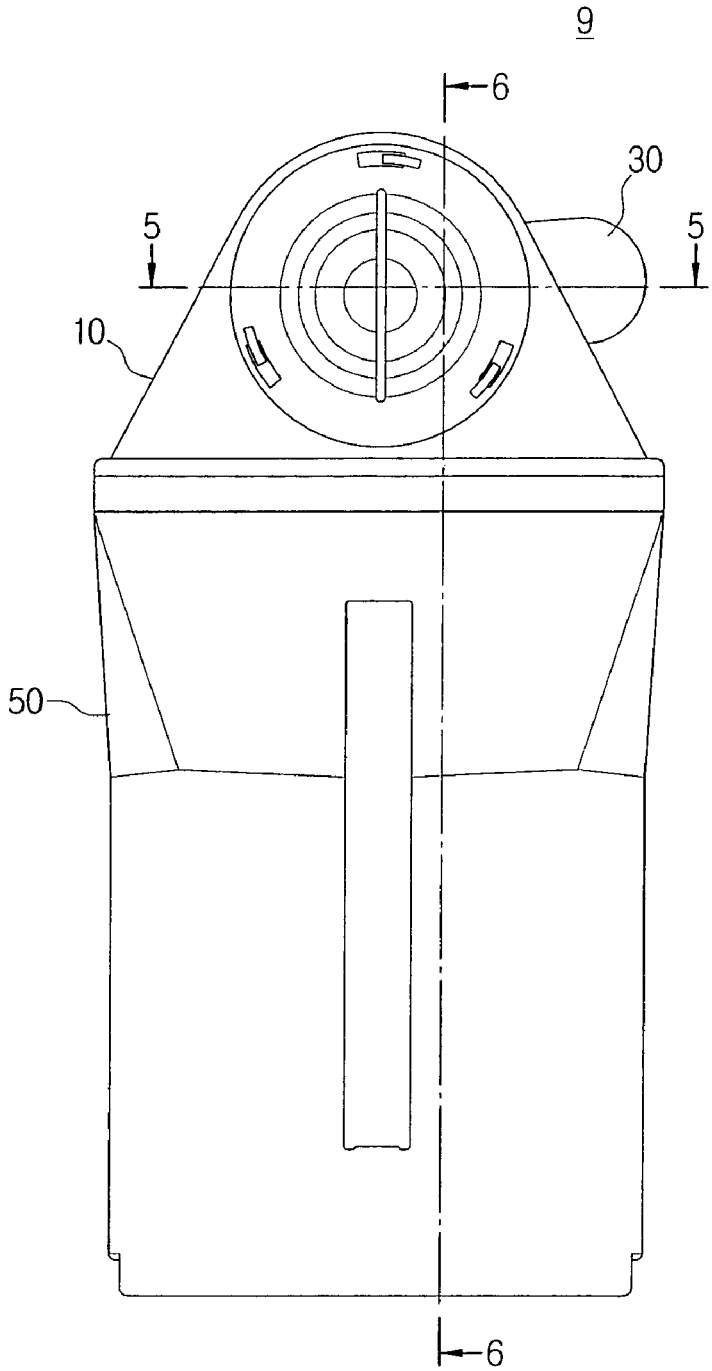
FIG. 1 is a front view exemplifying a cyclone dust-separating apparatus of a vacuum cleaner according to a first exemplary embodiment of the present disclosure.

Referring to FIG. 1, a cyclone dust-separating apparatus 9 according to a first exemplary embodiment of the present disclosure includes a cyclone unit 10 and a dust bin 50.

Figure 2:
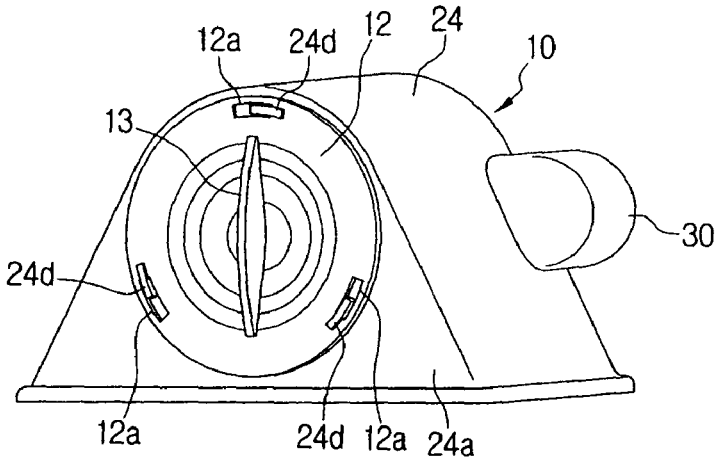
FIG. 2 is a perspective view exemplifying a cyclone unit of the cyclone dust-separating apparatus illustrated in FIG. 1.
Figure 3:
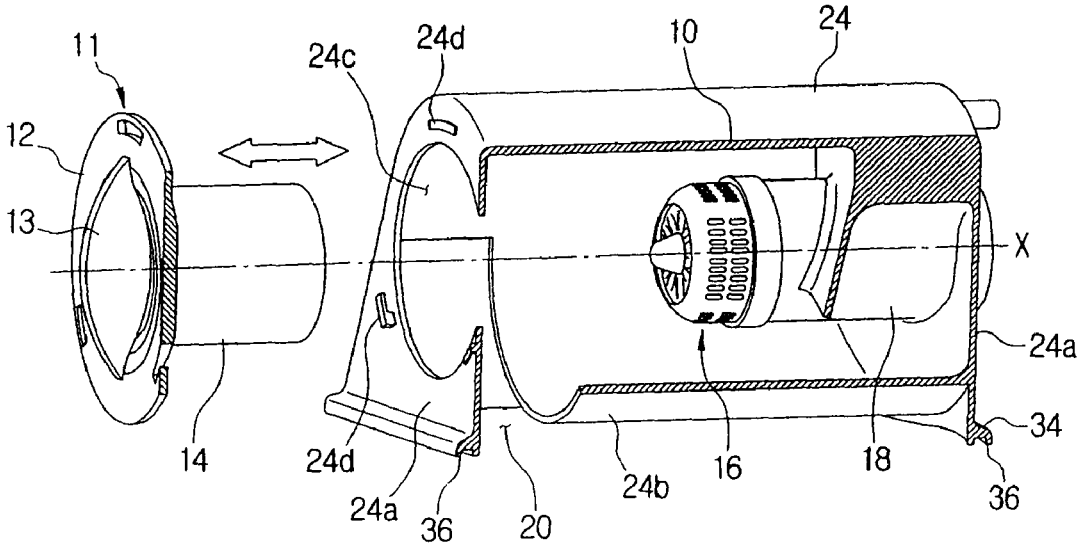
FIG. 3 is a partially cut-away and exploded perspective view of the cyclone unit of the cyclone dust-separating apparatus illustrated in FIG. 1.

Referring to FIGS. 2 and 3, the cyclone unit 10 is provided with a cyclone body 24, a guide unit 11, a filter 16, an outflow pipe 18 and an inflow pipe 30. In addition, the cyclone unit 10 horizontally extends, so that air is horizontally drawn thereinto and horizontally discharged therefrom. That is, the cyclone unit 10 is arranged in such a manner that its longitudinal axis or X-axis extends substantially in the horizontal direction, as illustrated in FIG. 3.

Referring to FIGS. 2 and 3, the cyclone body 24 is made up of opposite side walls 24*a*, each of which is formed in a generally triangular shape with a rounded top apex, and a cylindrical body part 24*b* interconnecting the side walls 24*a*. One side wall 24*a* is provided with a mounting opening 24*c*, in which the guide unit 11 is mounted, and the other side wall 24*a* is provided with the outflow pipe 18, which extends into the inside of the body part 24*b* and through which dirt-removed air can be discharged. Because the outflow pipe 18 extends parallel to the X-axis in the horizontal direction, an air outlet 26 (see FIG. 5) through which the air is discharged is also formed in the horizontal direction. In addition, an inflow pipe 30, through which external air is drawn in, is projected from the body part 24*b*. The cyclone body 24 has an extended part 34 extended around a lower end thereof to form an elongated groove 36 into which a top end of the dust bin 20 can be inserted. A sealing member (not shown) is inserted into the elongated groove 36 so as to seal a gap between the dust bin 50 and the cyclone body 24. A dirt discharge port 20 is formed at a side of the cyclone body 24, so that internal spaces of the cyclone body 24 and the dust bib 50 are communicated with each other and thus dirt or dust separated from the air drops into the dust bin 50. The dirt discharge port 20 is formed in the circumferential direction of the body part 24*b* of the cyclone body 24 below a guide pipe 14.

The guide unit 11 is mounted in the mounting opening 24*c* formed through one of the side walls 24*a* of the cyclone body 24. The guide unit 11 has a knob 12 and a guide pipe 14, wherein three locking holes 12*a* are formed in the knob 12 in the circumferential direction of the knob 12 and a handle 13 is projected from the center of the knob 12 so as to be capable of being gripped by a user. Locking projections 24*d* projecting from the side wall 24*a* of the cyclone body 12 are inserted into the locking holes 12*a*, respectively, so that the guide unit 11 is fixed to the cyclone body 24. The guide pipe 14 is connected to a side of the knob 12 and extends into the inside of the cyclone body 24. The guide unit 11 can be mounted in or removed from the cyclone body 24 merely by rotating the handle 13 of the knob 12 so as to rotate the guide unit about the X-axis.

The filter 16 is removably mounted on an end of the outflow pipe 18, and air drown in into the inside of the cyclone body 24 is discharged to the outside via the outflow pipe 18 after separating dirt or dust therefrom through the filter 16. In the present embodiment, the filter 16 is formed of a grill member with a plurality of through-holes. In the cyclone unit 10, the guide pipe 14 and the outflow pipe 18 are substantially horizontally arranged, namely parallel to the X-axis.

Figure 4:
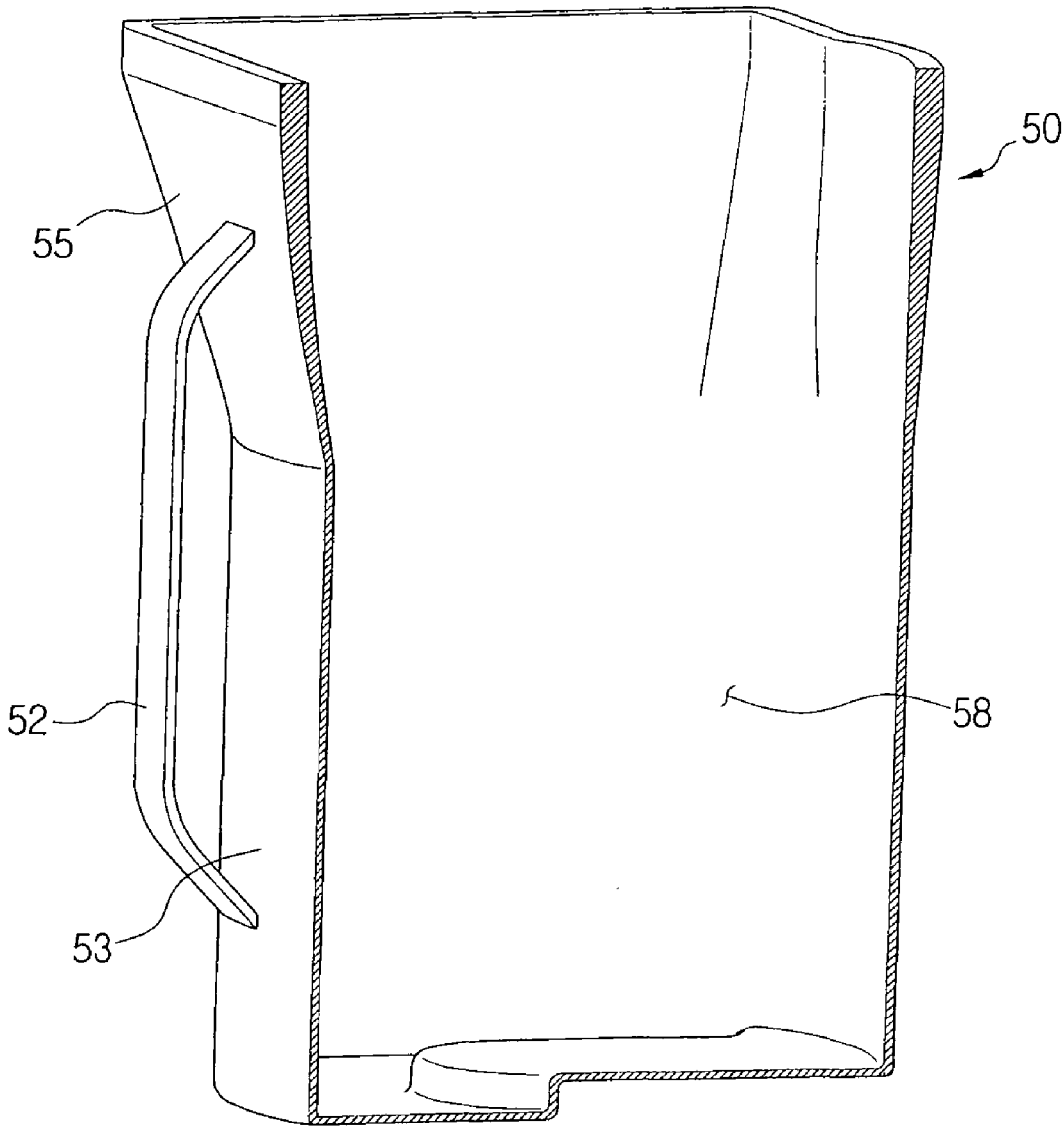
FIG. 4 is a partially cut-away perspective view of a dust bin of the cyclone dust-separating apparatus illustrated in FIG. 1.

Referring to FIGS. 1 and 4, the dust bin 50 is arranged so that a Y-axis thereof is vertically arranged. Thus, cyclone dust collector 9 includes dust bin 50 having a Y-axis that is perpendicular to the longitudinal or X-axis of the cyclone unit 10. In this manner, dust bin 50 has a very large volume as compared with that of cyclone dust collectors having a cyclone unit that is vertically arranged, so that the longitudinal axis of its dust bin is parallel to the longitudinal axis of the dust bin.

The dust bin 50 is removably coupled to a bottom end of the cyclone unit 10 and has a handle 52 at a side thereof, so that a user can grip the dust bin 50 thus to mount or remove it. The dust bin 50 has a cylindrical vertical part 53 vertically extended to a predetermined height from a bottom of the dust bin 50, and an enlarged part 55, the inner diameter of which is enlarged. A top end of the enlarged part 55 is inserted into the elongated groove 36 formed on the bottom end of the cyclone body 24. The vertical part 53 has a constant diameter and the enlarged part 55 has an inner diameter increasingly enlarged as approaching the top end thereof.

Figure 5:
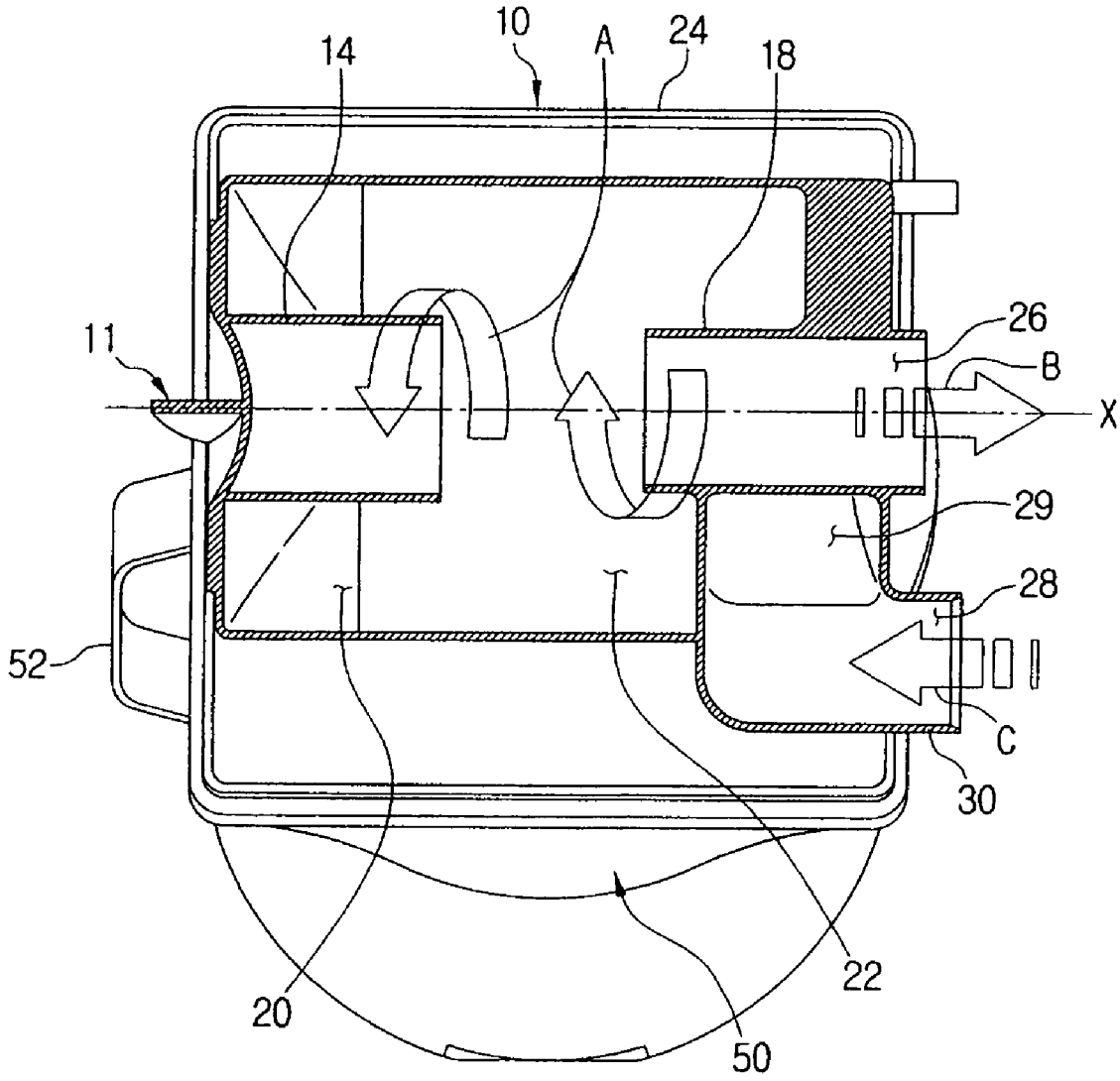
FIG. 5 is a cross-sectional view of the cyclone dust-separating apparatus, which is taken along line 5-5 in FIG. 1.

Referring to FIGS. 2 and 5, the inflow pipe 30 is provided on the cyclone body 24 in the same direction as that of the outflow pipe 18 and is projected from a side of the body part of the cyclone body 24 in such a manner that an air inlet 28 through which air is drawn in is formed in the horizontal direction, namely parallel to the X-axis. As illustrated in FIG. 5, the inflow pipe 30 is formed in an L-lettered shape.

Now, an operation of the cyclone dust-separating apparatus according to the first exemplary embodiment of the present embodiment will be described in detail with reference to FIGS. 5 and 6.

Figure 6:
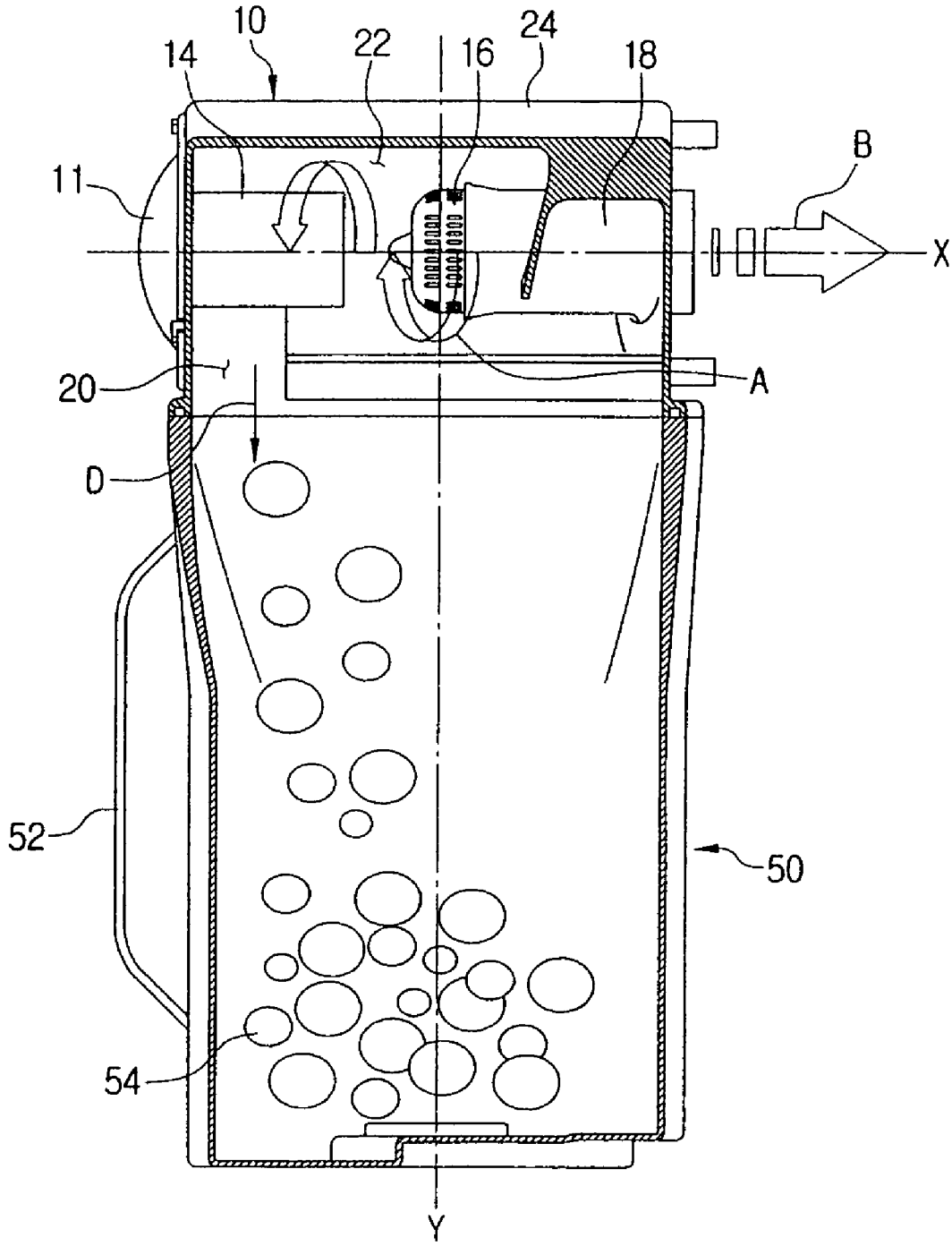
FIG. 6 is a cross-sectional view of the cyclone dust-separating apparatus, which is taken along line 6-6 in FIG. 1.

Referring to FIGS. 5 and 6, external air is drawn in through the air inlet 28 of the inflow pipe 30 projecting from the side of the cyclone body 24, as indicated by arrow C in FIG. 5. The air flows along the inflow pipe 30 and a curved air flow passage 29 within the cyclone body 24 and moves toward the guide pipe 14 while whirling around the outflow pipe 18, as indicated by arrows A in FIG. 5. The guide pipe 14 serves to prevent the air from being dispersed from the center of rotation. Dust or dirt 54 laden in the air drops in to the dust bin 50 through the dirt discharge port 20 as indicated by arrow D of FIG. 6. FIG. 6 illustrates the dust or dirt 54 dropping in to the dust bin 50. Although dust or dirt 54, which is heavier than the air, thereby being subjected to higher centrifugal force, drops to the dust bin 50, the air is turned toward the filter 16 by a suction force transferred through the outflow pipe 18 as indicated by arrow B in FIG. 5. Further, any dust or dirt 54, which has not yet removed from the air, is then separated from the air while the air is passing through the filter 16. And then, the air is discharged toward a vacuum motor (not illustrated) of the vacuum cleaner through the outflow pipe 18 and the air outlet 26. Because the whirling air stream formed in the cyclone chamber 22 is not transferred to the dust bin 50, the dust or dirt 54 dropped into the dust bin 50 through the dirt discharge port 20 substantially does not flow backward to the cyclone unit 10. In addition, because the cyclone unit 10 is arranged horizontally as illustrated in FIG. 6, it is possible to reduce the entire height of the cyclone dust-separating apparatus 9. Accordingly, if the cyclone dust-separating apparatus is configured in the same height as the conventional cyclone dust-separating apparatus with the vertical cyclone unit, the volume of the dust bin can be substantially increased as compared to that of the conventional one, whereby a period for emptying the dust bin can be greatly increased.

If the user wants to dump the dust or dirt collected in the dust bin 50, she or he grips the handle 52 provided on the dust bin 50 and removes the dust bin 50 from the cyclone unit 10. In case that the cyclone dust-separating apparatus 9 according to the first exemplary embodiment of the present disclosure is applied to an upright cleaner, the dust bin 50 at the lower end thereof may includes a cam structure (not illustrated) for vertically moving the dust bin 50, and a lever structure (not illustrated) which can be vertically moved by the cam structure. Because these cam and lever structures are well-known in the art, the detailed description thereof is omitted. In addition, if the user wants to clean the filter 16 of the cyclone unit 10 or the inside of the cyclone chamber 22, she or he removes the filter 16 from the outflow pipe 18 so as to clean the filter 16 or cleans the cyclone chamber 22 through the mounting opening 24*c* formed on the cyclone body 24, after removing the guide unit 11 from the cyclone body 24.

Figure 7:
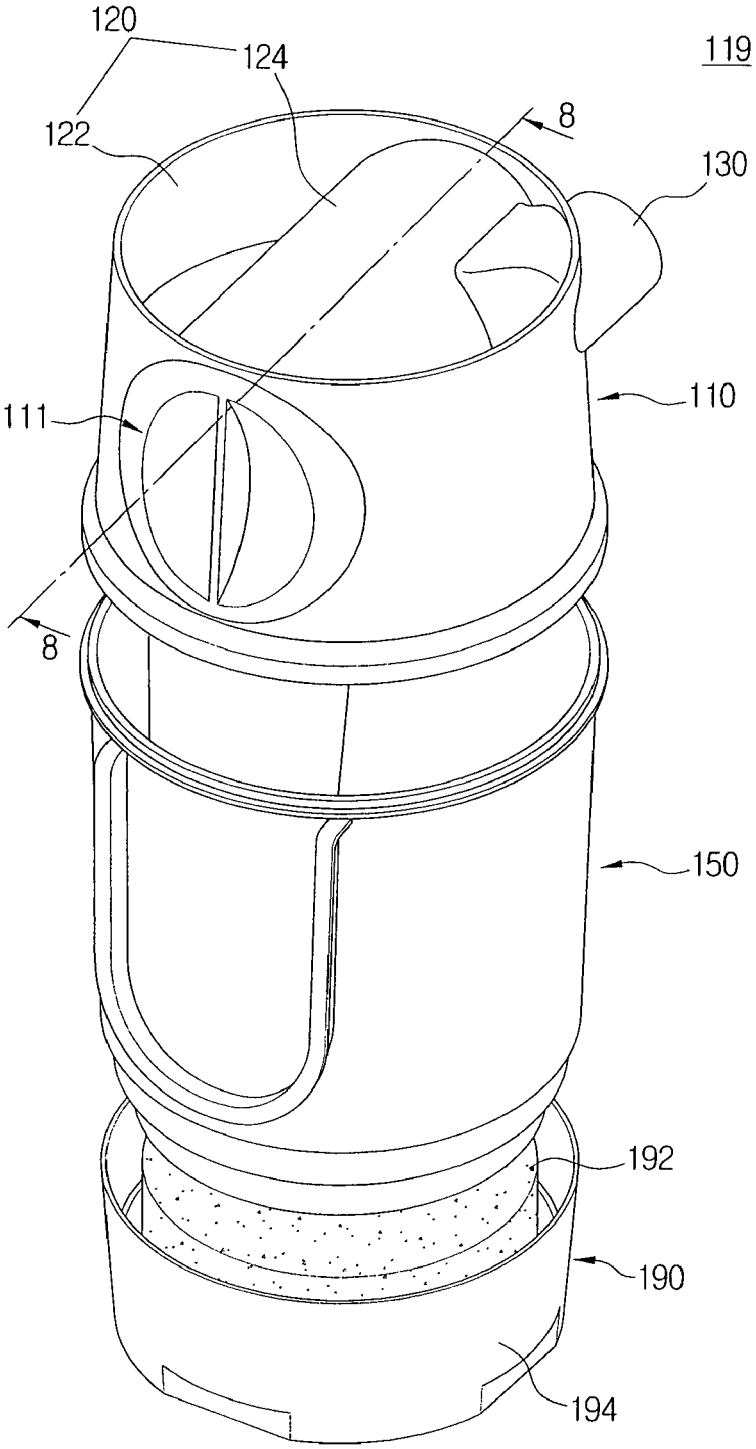
FIG. 7 is an exploded perspective view exemplifying a cyclone dust-separating apparatus of a vacuum cleaner according to a second exemplary embodiment of the present disclosure.
Figure 8:
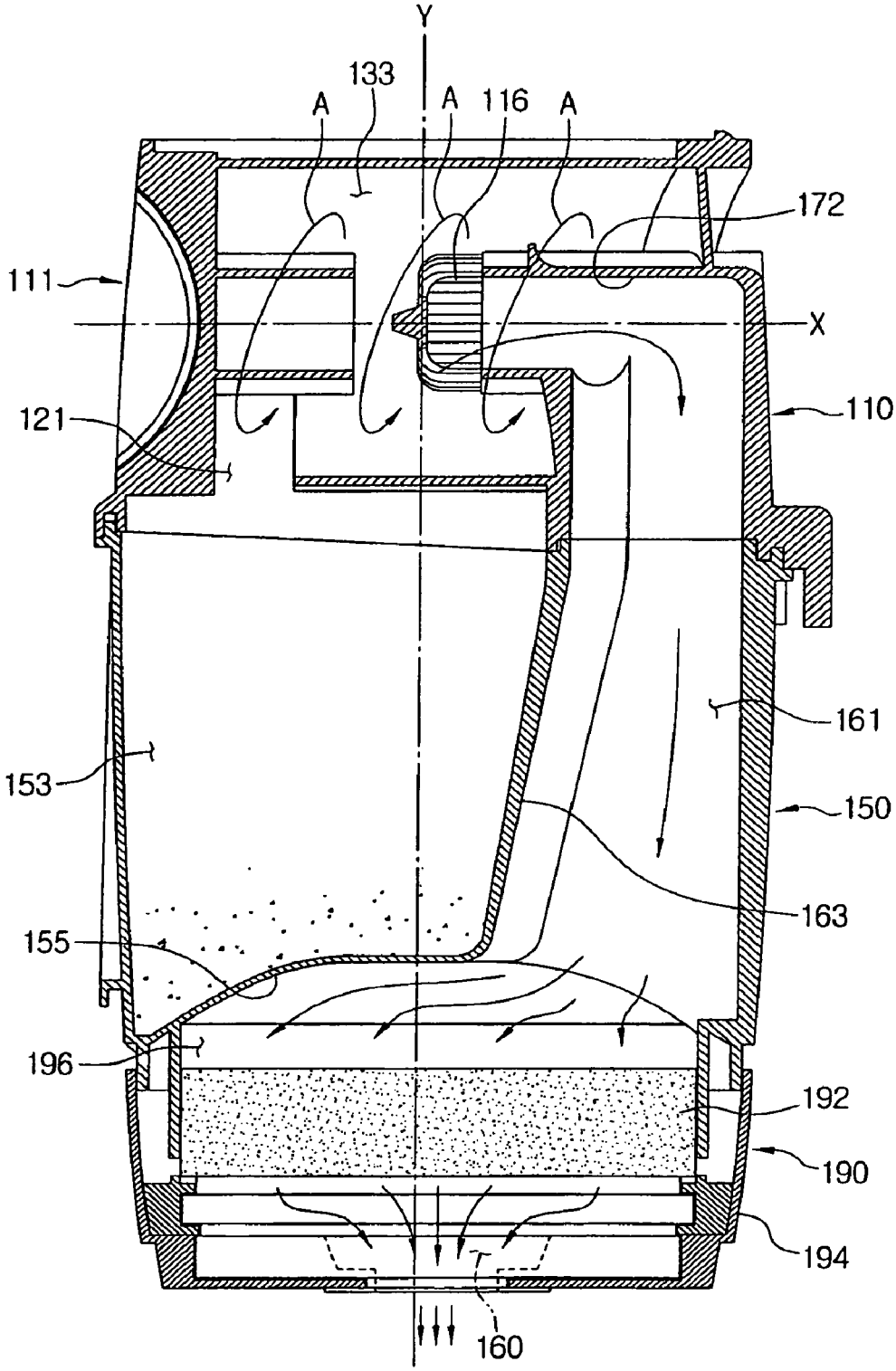
FIG. 8 is a cross-sectional view of the cyclone dust-separating apparatus, which is taken along line 8-8 in FIG. 7.

FIGS. 7 and 8 are views exemplifying a cyclone dust-separating apparatus of a vacuum cleaner according to a second exemplary embodiment of the present disclosure. Referring to FIGS. 7 and 8, the cyclone dust-separating apparatus 119 according to the second exemplary embodiment of the present disclosure includes a cyclone unit 110, a dust bin 150, and a filter unit 190.

The cyclone unit 110 is provided with a cyclone body 120, a guide unit 111 detachably mounted on a side of the cyclone body 120, a filter 116, an outflow pipe 172, and an inflow pipe 130. Because constructions of the guide unit 111, the filter 116, and the inflow pipe 130 are the same as those of the cyclone unit 10 of the first exemplary embodiment as described above, the detailed description thereof will be omitted for clarity and conciseness.

The cyclone body 120 has an outer body 122 and an inner body 124. The inner body 124 is formed in the same shape as the cyclone body 24 of the first exemplary embodiment, but surrounded with the outer body 122. That is, the inner body 124 is formed in a laid cylinder shape arranged in such a manner that its longitudinal axis X extends substantially in the horizontal direction, as explained in the cyclone body 24 of the first exemplary embodiment, and the outer body 122 is formed in a stand-up cylinder shape arranged in such a manner that its longitudinal axis Y extends substantially in the vertical direction.

As illustrated in FIG. 8, the outflow pipe 172 is formed in a generally inverted L-lettered or ‘┐’shape and penetrates the dust bin chamber of the dust bin in vertical direction. On one end of the outflow pipe 172 is installed the filter 116, and to the other end of the outflow pipe 172 is connected an air outflow passage 161 formed in the dust bin 150. Accordingly, after whirling within a cyclone chamber 133, air passes through the filter 116 and discharges through the air outflow passage 161 of the dust bin 150 via the outflow pipe 172 of the inverted L-lettered or ‘┐’shape.

The dust bin 150 is divided into a dust-collecting chamber 153 and an air outflow passage 161 by a partition 163. A bottom surface 155 of the dust bin 150 is formed to protuberate toward the dust-collecting chamber 153 and the air outflow passage 161. The air outflow passage 161 can be formed in a pipe shape, but is not limited thereto. A top end of the air outflow passage 161 joined with the outflow pipe 172 has the same inner diameter as the outflow pipe 172. The outflow pipe 172 is configured, so that its lower part has an inner diameter gradually enlarged larger than that of its upper part, thereby allowing its bottom end to have the largest passage width. Accordingly, the more the air gets near to the bottom end of outflow pipe 172, the more the flow speed of the air is reduced.

The filter unit 190 is joined to a bottom end of the dust bin 150, and includes a filter cover 194 and a filter member 191. The filter cover 194 is detachably locked and fixed to the bottom end of the dust bin 150, and forms a filter chamber 196 of predetermined volume therein. In addition, the filter cover 194 has an opening 160 formed at a bottom surface thereof to discharge the air passing through the filter chamber 192. The filter member 192 is formed of a porous filter, such as a sponge or the like, and is disposed in the filter chamber 196.

Hereinafter, an operation of the cyclone dust-separating apparatus 119 according to the second exemplary embodiment of the present embodiment will be described in detail with reference to FIGS. 7 and 8. If external air is drawn into the cyclone chamber 133 through the inflow pipe 130, it drops dust or dirt into the dust-collecting chamber 153 of the dust bin 150 joined to the bottom end of the cyclone chamber 133 through the dirt discharge port 121 while whirling as indicated by arrows A in FIG. 8. With a suction force, the air from which the dust or dirt is removed as described above passes through the filter 116, and bends its flow from a horizontal direction to a vertical-and-down direction while passing through the outflow pipe 172. While the air passes through the air outflow passage 161 formed on the side of the dust bin 150, the flow speed of the air is slow down. When the air reaches the filter chamber 196, the flow speed of the air goes down abruptly. As a result, the air passes in a slow speed through the filter member 192 disposed in the filter chamber 196, and thus fine dust remained in the air is collected by the filter member 192. And then, the fine dust-removed air is discharged to the outside of the cyclone dust-separating apparatus 119 through the opening 160 formed in the filter cover 194.

As apparent from the foregoing description, according to the exemplary embodiments of the present disclosure, the cyclone dust-separating apparatus is configured, so that the cyclone unit is installed to have the longitudinal axis horizontally arranged and the height of the dust bin is increased. Accordingly, the cyclone dust-separating apparatus according to the exemplary embodiments of the present disclosure can increase the capacity of the dust bin, thereby improving the convenience in use.

Further, the cyclone dust-separating apparatus according to the exemplary embodiments of the present disclosure has the horizontal cyclone unit and the vertical dust bin. Accordingly, because the air stream whirling in the cyclone unit is not spread to the inside of the dust bin, the dust or dirt stored in the dust bin is prevented from flowing backward to the cyclone unit again.

In addition, the cyclone dust-separating apparatus according to the exemplary embodiments of the present disclosure is configured, so that the guide unit is removably mounted on the cyclone body. Accordingly, the cyclone dust-separating apparatus according to the exemplary embodiments of the present disclosure is convenient to clean the inside of the cyclone unit and the filter.

Also, the cyclone dust-separating apparatus according to the exemplary embodiments of the present disclosure is configured, so that the air inlet and the air outlet are horizontally formed. Accordingly, the cyclone dust-separating apparatus according to the exemplary embodiments of the present disclosure is easy to install the piping in the vacuum cleaner.

More, the cyclone dust-separating apparatus according to the exemplary embodiments of the present disclosure is configured, so that the guide pipe extends into the cyclone unit from the guide unit by a predetermined length. Accordingly, the cyclone dust-separating apparatus according to the exemplary embodiments of the present disclosure allows the whirling air stream formed in the cyclone chamber to retain the rotating force without being dispersed.

Furthermore, the cyclone dust-separating apparatus according to the exemplary embodiments of the present disclosure is configured, so that the air flow passage discharging the air from the cyclone unit passes through the dust bin, thereby reducing the piping loss of the discharged air and the filter unit filters the fine dust laden in the air once again, thereby improving the dust-separating efficiency.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-separating apparatus comprising:

a cyclone unit having an air inlet and an air outlet so as to separate dust or dirt from air, the cyclone unit being installed in such a manner that a longitudinal axis thereof is substantially horizontally arranged; and a dust bin joined to a bottom end of the cyclone unit so as to store the dust or dirt separated by the cyclone unit, the dust bin being installed in such a manner that a longitudinal axis thereof is substantially perpendicular to the longitudinal axis of the cyclone unit, wherein the cyclone unit comprises: a cyclone body; a guide unit on one side of the cyclone body; an outflow pipe on another side of the cyclone body; and a filter on one end of the outflow pipe, and wherein the guide unit is detachably mounted on the one side of the cyclone body.

2. The apparatus as claimed in claim 1, wherein the guide unit comprises a guide pipe, a knob connected to one end of the guide pipe, and a handle formed on the knob.

3. The apparatus as claimed in claim 2, wherein the knob has one or more locking hole formed thereon and the cyclone body has one or more locking projections formed at the positions corresponding to the locking hole, so that the guide unit is coupled to the cyclone unit when the locking projection are inserted into the locking hole.

4. The apparatus as claimed in claim 1, wherein the cyclone body comprises a dirt discharge port circumferentially formed in a direction where the guide unit is mounted, so that separated dust or dirt drops to the dust bin through the dirt discharge port.

5. The apparatus as claimed in claim 1, further comprising an inflow pipe projecting from other side of the cyclone body.

6. The apparatus as claimed in claim 1, wherein the air inlet and air outlet are horizontally formed.

7. The apparatus as claimed in claim 1, wherein the dust bin comprises a cylindrical vertical part having a diameter that is constant, and an enlarged parthaving a diameter that is varied.

8. A cyclone dust-separating apparatus comprising:

a cyclone unit having an air inlet and an air outlet so as to separate dust or dirt from air, the cyclone unit being installed in such a manner that a longitudinal axis thereof is substantially horizontally arranged; and a dust bin joined to a bottom end of the cyclone unit so as to store dust or dirt separated by the cyclone unit, the dust bin being installed in such a manner that a longitudinal axis thereof is substantially perpendicular to the longitudinal axis of the cyclone unit, wherein the dust bin has an air outflow passage connected with the air outlet, so that air discharged from the cyclone unit passes through the dust bin and then discharges in a bottom end direction of the dust bin, wherein the air outflow passage is disposed to penetrate a dust bin chamber of the dust bin in a vertical direction.

9. The apparatus as claimed in claim 8, wherein the air outflow passage is formed on a side of the dust bin chamber, so that a lower part thereof has a passage width larger than that of an upper part thereof.

10. The apparatus as claimed in claim 8, further comprising a filter unit joined to a bottom end of the dust bin to filter dust laden in the air discharged from the cyclone unit.

11. The apparatus as claimed in claim 10, wherein the filter unit comprises a filter cover joined to the bottom end of the dust bin to form a filter chamber of predetermined volume, and a filter member installed in the filter chamber.

12. The apparatus as claimed in claim 11, wherein the filter cover has an air-dischargable opening formed at a bottom surface thereof, so that air passing through the filter member is discharged through a lower part of the filter cover.

13. A cyclone dust-separating apparatus comprising:

a cyclone unit having an air inlet and an air outlet so as to separate dust or dirt from air, the cyclone unit being installed in such a manner that a longitudinal axis thereof is substantially horizontally arranged; and a dust bin joined to a bottom end of the cyclone unit so as to store dust or dirt separated by the cyclone unit, the dust bin being installed in such a manner that a longitudinal axis thereof is substantially perpendicular to the longitudinal axis of the cyclone unit, wherein the dust bin has an air outflow passage connected with the air outlet, so that air discharged from the cyclone unit passes through the dust bin and then discharges in a bottom end direction of the dust bin, wherein the cyclone unit comprises a cyclone body, and a guide unit detachably mounted on the cyclone body, and the cyclone body comprises an inner body to form a cyclone chamber, and an outer body to surround the inner body.

14. The apparatus as claimed in claim 13, wherein the inner body is formed in a laid cylinder shape, and the outer body is formed in a stand-up cylinder shape.

* * * * *